United States Patent [19]

Nafziger

[11] 3,950,163

[45] Apr. 13, 1976

[54] QUATERNARY FLUXES FOR ELECTROSLAG REMELTING FERROUS ALLOYS AND SUPERALLOYS

[75] Inventor: Ralph Hamilton Nafziger, Albany, Oreg.

[73] Assignee: The United States of America as represented by the Secretary of the Interior, Washington, D.C.

[22] Filed: Jan. 8, 1975

[21] Appl. No.: 539,469

[52] U.S. Cl. ..... 75/94; 75/10 R; 75/53

[51] Int. Cl.[2] ..... C22B 9/10; C22B 4/00

[58] Field of Search ..... 75/53, 58, 94, 10, 12; 148/26

[56] References Cited

OTHER PUBLICATIONS

Nikitin et al., "Equilibrium Diagram of the Al, Ca, Mg, 11F, O System," Reprinted in English Translation from: Russian Journal of Inorganic Chemistry 18 (7), 1973.

*Primary Examiner*—Peter D. Rosenberg

*Attorney, Agent, or Firm*—Roland H. Shubert; Donald R. Fraser

[57] ABSTRACT

A quaternary flux composition for electroslag consumable electrode remelting of superalloys and ferrous base alloys in weight percent consisting of about 40% $CaF_2$, 20% $Al_2O_3$, 36% CaO and 4% MgO.

3 Claims, No Drawings

QUATERNARY FLUXES FOR ELECTROSLAG REMELTING FERROUS ALLOYS AND SUPERALLOYS

BACKGROUND OF THE INVENTION

This invention relates to a flux composition intended for use primarily in the electroslag consumable electrode process for remelting a wide variety of metals, including ferrous alloys and superalloys. The flux however may be employed in other arc melting processes, as may be applicable. "Electric Melting Practice" by Robiette (1972), Wiley and Sons publisher, describes the electroslag process, and recourse may be had thereto for a further description of this process.

SUMMARY OF THE INVENTION

Ternary flux compositions in the system $CaF_2$—CaO—$Al_2O_3$ have been widely used in the electroslag remelting of superalloys and specialty steels. Experimental addition of MgO to the flux increased the melting rates up to 32 percent higher and decreased energy consumption up to 25 percent as compared with binary and ternary fluxes. This may be attributed to lower electrical conductivities and slightly higher viscosities of the quaternary fluxes at higher temperatures.

Typical of the quaternary flux compositions hitherto employed were $18CaF_2$—25CaO—17MgO—$40Al_2O_3$ and $30CaF_2$—17CaO—13MgO—$40Al_2O_3$. During the course of electroslag remelting of 316 stainless steel with variations of former, and of cobalt base superalloys with variations of the latter, certain problems manifested themselves. It was found difficult to obtain a completely molten flux, the electrode often stuck to the flux, causing undesirable arcing and erratic melt operations, and ingot surfaces were often rough.

Among the objects of the present invention are:

1. To provide quaternary fluxes of the $CaF_2$—CaO—MgO—$Al_2O_3$ system for use in the electroslag process for melting cobalt-base superalloys and other ferrous alloys having relatively low liquidus temperatures, said fluxes have an $Al_2O_3$ content of about 20 weight percent, have a suitably low liquidus temperature and are electrically resistive enough to support required current density to prepare ingots by the electroslag process which are free from porosity or other internal defects, have smooth directly workable surfaces and have axial grain orientation.

2. The flux of 1 wherein the preferred composition is about $40CaF_2$—36CaO—4MgO—$20Al_2O_3$.

Further objects will become apparent from the description of the invention and the claims.

DESCRIPTION OF THE INVENTION

Remelting cobalt-base superalloys by the electroslag process requires fluxes with low liquidus temperatures and sufficiently high electrical resistivity to support the required current density to prepare satisfactory ingots. As stated previously, the various fluxes within the quaternary system $CaF_2$—CaO—MgO—$Al_2O_3$ has been employed in electroslag remelting. It was found that flux melting temperatures increase most substantially with increasing MgO, and to a lesser extent, with increasing $CaF_2$. U.S. Pat. No. 3,551,137 describes as a preferred embodiment $30CaF_2$—17CaO—13MgO—$0Al_2O_3$ having a melting temperature of about 1320° ± 10°C.

I have discovered that a quaternary flux having the broad composition range of about $40CaF_2$—36CaO—4MgO—$20Al_2O_3$ has a liquidus temperature of 1171° ± 3°C. This low temperature is attributed to a quaternary eutectic composition with $MgO.Al_2O_3$ (spinel), $11CaO.7Al_2O_3.CaF_2$, $CaF_2$ and MgO solid phases in equilibrium with liquid. The melting range of this preferred flux composition is therefore negligible, which is an important advantage in terms of electric power utilization during electroslag melting.

The reduction of $Al_2O_3$ content from the high values previously employed lowers the flux liquidus temperature so that there is a greater liquidus temperature difference between the flux and the metal to be melted by the electroslag process. This enables the flux to be completely molten before alloys such as cobalt-base superalloys (e.g. MAR-M509, MAR-M302, X45) begin to melt. The liquidus temperatures of the above alloys are respectively: 1343°–1356°C., 1316°C. and 1333°C. It is apparent that the differences between the liquidus temperature of the flux composition (1171° ± 3°C.) and those of the alloys are substantial. A more freely consuming electrode, a smoother melt and better ingot surface properties result therefrom.

The primary phase of the flux is $11CaO.7Al_2O_3.CaF_2$, which melts at 1412°C. In the electroslag crucible, the walls are covered by a thin layer of flux. On cooling to below 1412°C., the primary phase crystallizes on the crucible wall while the alloy remains molten, whereby smooth ingot surfaces result.

A lower $Al_2O_3$ content in the flux reduces the flux viscosity which enhances gas removal during melting, lowers the specific electrical resistivity for more economical melting operations, reduces the chances for excessive undesirable globular oxide inclusions of $Al_2O_3$ to appear in the ingot metal and provides sounder superalloy ingots.

EXAMPLE

The flux of this invention is prepared by combining the proper weight percentages of calcium fluoride, calcium oxide, magnesia and alumina, said components having been previously heated to drive off moisture and other volatile impurities. The starting components may be pure compounds, or commercial grades or naturally occuring materials such as fluorspar, lime, periclase and corundum. The compounds are mechanically blended to form a homogenous mixture which is then briquetted, fused in an inert atmosphere and then crushed. While immediate use is preferred, the crushed flux can be stored in an inert atmosphere and/or at temperatures above 200°C.

The flux composition is then employed in the electroslag process empolying a superalloy or ferrous base alloy consumable electrode in the manner taught by the prior art.

What is claimed is:

1. A flux composition for use in electroslag remelting of metals consisting, in weight percent, 40% $CaF_2$, 37% CaO, 4% MgO and 20% $Al_2O_3$, the percentages being selected to add to 100 percent.

2. A flux according to claim 1 which at liquidus temperature approaches a quaternary eutectic composition with $MgO.Al_2O_3$, $11CaO.7Al_2O_3.CaF_2$, $CaF_2$ and MgO solid phases in equilibrium with liquid.

3. The flux according to claim 2 wherein its melting range is about 1171° ± 3°C.

* * * * *